US008069659B2

(12) United States Patent
Kellermann

(10) Patent No.: US 8,069,659 B2
(45) Date of Patent: Dec. 6, 2011

(54) MULTIPLE-SHELL SILENCER / REAR SHELL PORT

(75) Inventor: Christian Kellermann, Stapelfeld (DE)

(73) Assignee: Dolmar GmbH, Hamburg (DE)

( * ) Notice: Subject to any disclaimer, the term of this patent is extended or adjusted under 35 U.S.C. 154(b) by 1133 days.

(21) Appl. No.: 11/846,858

(22) Filed: Aug. 29, 2007

(65) Prior Publication Data

US 2008/0127639 A1 Jun. 5, 2008

(30) Foreign Application Priority Data

Aug. 31, 2006 (DE) ..... 20 2006 013 382 U

(51) Int. Cl.
*F01N 3/00* (2006.01)

(52) U.S. Cl. ..... 60/299; 60/324

(58) Field of Classification Search ..... 60/299, 60/302, 323, 324
See application file for complete search history.

(56) References Cited

U.S. PATENT DOCUMENTS 3,914,936 A * 10/1975 Okitsu et al. ..... 60/282
5,857,327 A * 1/1999 Sato et al. ..... 60/302
6,341,662 B1 1/2002 Karlsson
6,393,835 B1 * 5/2002 Stoll et al. ..... 60/299
6,457,553 B1 10/2002 Goplen et al.
6,789,644 B2 * 9/2004 Mukaida ..... 181/272
2003/0085072 A1 5/2003 Mukaida

FOREIGN PATENT DOCUMENTS

DE 197 47 914 A1 5/1999
DE 101 46 513 A1 4/2003
DE 10 2005 037102 A1 2/2006

* cited by examiner

*Primary Examiner* — Thomas Denion
*Assistant Examiner* — Diem Tran
(74) *Attorney, Agent, or Firm* — Kelly Lowry & Kelley, LLP

(57) ABSTRACT

An exhaust system for an internal combustion engine includes an outer housing having a front shell and a rear shell, a prechamber in which exhaust gas from the combustion chamber enters, and an intermediate shell having a front and back as well as a catalytic converter holder. A catalytic converter element is arranged on the catalytic converter holder where an exhaust port directs exhaust gas from the catalytic converter element. To place the center of gravity of the exhaust system near the internal combustion engine or cylinder, the intermediate shell forms the prechamber and the exhaust port.

19 Claims, 5 Drawing Sheets

MULTIPLE-SHELL SILENCER / REAR SHELL PORT

TECHNICAL AREA

The present invention relates to an exhaust system for an internal combustion engine according to the preamble of claim 1. Such exhaust systems can be used with a four-stroke or a two-stroke petrol engine. Because of the compact design of the exhaust system it can also be used for hand-operated or hand-held implements such as for instance petrol engine-driven disc grinders, chain saws, hedge clippers or such like. Exhaust systems of this type have an outer housing which contains at least a front shell and a rear shell. In addition a prechamber is provided which the exhaust gas enters from the combustion chamber. In addition, at least one intermediate shell having a front side and a rear side and at least one catalytic converter holder can be present, while a catalytic converter element for cleaning the exhaust gas is arranged on the catalytic converter holder. In addition, the exhaust system is equipped with an exhaust port from which the exhaust gas is directed out of the catalytic converter element.

PRIOR ART

DE 38 29 668 C2 for example is known from the prior art which discloses an exhaust system for a two-stroke engine in a portable implement. This exhaust system also is of a compact design where in the middle region of the exhaust system a three-dimensional catalytic converter element for the treatment of the exhaust gases from the internal combustion engine is employed. In order to be able to cool the exhaust gases that are heated-up after the catalytic converter a tube construction after the catalytic converter element is provided in the interior of the exhaust system around which unconverted and thus less hot exhaust gas flows. As a result, the outer shells are protected from the high temperatures of the converted exhaust gas. The design for the exhaust system known from DE 38 29 668 C2 has many components which are elaborate to manufacture and have a corresponding weight. In addition, the assembly of the mentioned exhaust system is complicated and time-consuming.

DE 37 29 477 C3 from the prior art also discloses an exhaust system for two-stroke engines, more preferably for portable implements such as for example power chainsaws. This exhaust system likewise has a catalytic converter element arranged in the middle of a separating wall. Here, the separating wall divides the exhaust system in two regions which are separated from each other gas-tight. In the only aperture in the separating wall the already mentioned catalytic converter element is arranged in order to bring about complete cleaning of the exhaust gas from the internal combustion engine. Consequently the exhaust gas is forced at any rate to pass the catalytic converter element before it is able to get from the exhaust system into the ambient air. For cooling the hot exhaust gases originating from the catalytic converter an exposed guide tube is provided which is cooled by the ambient air. As an option, an outer heat shield is provided with the exhaust system which can be cooled by a cooling flow of the engine. This additional heat shield serves to avoid direct contact with the outer housing of the exhaust system in order to prevent more preferably burns. The entire exhaust system is a less compact construction and consists of many individual components which require a lot of manufacturing effort to produce. In addition, the known exhaust system is relatively heavy, even due to the fact that a separate guide tube or a heat shield is provided. Through the special construction the centre of gravity of the exhaust system is located far away from the internal combustion engine.

In addition, an exhaust system is known from the prior art which is used with hand-held implements. Especially with power saws the exhaust system is attached directly to the cylinder without any additional fastening being provided on the machine. To this end it is required that the centre of gravity of the exhaust system is arranged as closely as possible to the cylinder so that the load for the connecting screws and the outer shells of the exhaust system is as low as possible. Such an exhaust system is directly filled with the unconverted exhaust gases from the internal combustion engine or cylinder. The front shell of the outer housing forms an exhaust port and a catalytic converter holder from two deep-drawn sheets so that only the front shell located on the outside on the machine is subjected to a higher thermal load through the cleaned exhaust gases. An additional head shield is frequently employed through which the outer temperature on the front shell is to be reduced to an acceptable level. Although this exhaust system is simple in construction it has the disadvantage that the front shell still gets relatively hot. Through the additionally provided heat shield the centre of gravity of the exhaust system is shifted further outward, i.e. away from the cylinder, as a result of which an additional fastening on the hand-held implement becomes necessary.

PRESENTATION OF THE INVENTION OBJECT, SOLUTION, ADVANTAGES

It is thus the object of the present invention to provide an exhaust system for an internal combustion engine with a catalytic converter element which is of a simple and compact design requiring only few components. In addition, the centre of gravity of the exhaust system is to be arranged closely to the internal combustion engine or cylinder.

This object is solved through an exhaust system with the characteristics of claim 1.

Practical developments of the invention are stated in the dependent claims 1 to 18.

With the new exhaust system it is provided according to the invention that the intermediate shell forms the prechamber and the exhaust port at the same time. Here, the invention is based on preferably not heating the front shell through the hot converted exhaust gases from the catalytic converter element but rather the rear shell, which is located closely to the internal combustion engine and thus is inaccessible per se. Consequently no further technical characteristics are necessary to cool down the front shell since—because of the chosen design—it does not come in contact with the highly heated exhaust gases from the catalytic converter element. Consequently an additional heat shield on the front shell of the exhaust system can be omitted. In this way it can be achieved that the centre of gravity of the exhaust system does not shift to the front shell but to the internal combustion engine. For cooling the rear shell which now comes in contact with the hot combustion exhaust gases an existing cylinder cooling air flow from the outside can be used. This cooling airflow is generally available with internal combustion engines. Likewise the exhaust gas exiting from the exhaust system can be swirled-up with this cylinder cooling airflow. Thus, the exhaust system according to the invention advantageously utilizes various synergy effects.

With a version of the exhaust system according to the invention it is practically provided that the intermediate shell forms the prechamber with the front shell and the exhaust port with the rear shell. Thus the intermediate shell assumes two functions. Through the skilful design of the prechamber in the intermediate shell the exhaust port is realized at the same time. Here, the prechamber is provided in the front of the intermediate shell and the exhaust port in the back of the intermediate shell. Both the prechamber and the exhaust port can be moulded in the intermediate shell of a uniform material and in one piece. It is likewise conceivable that the catalytic converter holder is more preferably moulded in the intermediate shell of uniform material and in one piece. Thus, the intermediate shell is of substantial significance for the construction of the exhaust system according to the invention. The particular shape of the intermediate shell can be achieved through deep drawing. It is likewise conceivable that suitable elements for forming the prechamber, the exhaust port and/or the catalytic converter holder are welded, riveted or such like to the intermediate shell.

To cool the converted exhaust gas originating from the catalytic converter element in the exhaust port the exhaust port is guided more preferably O or U-shaped about the prechamber. Thus the prechamber simultaneously serves to cool the hot exhaust port. Through the skilful design of the prechamber, which for example can have the outer shape of a "P" the exhaust port can be laid. Here it is conceivable through additional projections and bulges in the prechamber which protrude into the exhaust port to improve the cooling of the exhaust port. In addition, the exhaust port can be curved and/or designed meander-shaped. Likewise, additional cooling surfaces can optionally protrude from the prechamber into the exhaust port in order to bring about an improved heat exchange between the prechamber and the exhaust port. Here it has to be mentioned once more that the front shell with the exhaust system according to the invention does not come in direct contact with the hot converted exhaust gas and thus is of a rather cool design. Conversely, the rear shell can come in direct contact with the hot converted exhaust gas from the catalytic converter element as a result of which additional heating can occur. This addition heat on the rear shell can be discharged through the engine cooling air. To this end suitable cooling surfaces or ribs can be designed on the rear shell.

Furthermore, with an additional version of the exhaust system, a storage chamber can be arranged upstream of the exhaust port which is likewise formed from the intermediate shell. This storage chamber can also be realized through the special design of the prechamber (see "P"-shape of the outer contour). The storage chamber can serve as so-called resonator chamber as a result of which any flames present in the exhaust gas can be extinguished. This takes place in that the exhaust gas initially passes through the catalytic converter into the storage chamber so that it can subsequently exit the exhaust system through the U-shaped exhaust port. Through the sudden increase in the flow cross section downstream of the catalytic converter element or the perforation in the intermediate shell swirling of the exhaust gas occurs which result in the extinguishing of the flames in the exhaust gas. Thus it can be ensured through the storage chamber that no flames exit the exhaust outlet aperture with the treated exhaust gas.

By using the intermediate shell in the exhaust system according to the invention a sub-division of the interior space of the exhaust system in two gas-tight regions can be brought about. Here, the intermediate shell has only two through apertures, namely on the one hand for the entry of the untreated exhaust gas from the internal combustion engine and on the other hand an aperture in which preferably the catalytic converter element is arranged, through which the hot treated exhaust gases can reach. The first region has the prechamber and the second region the exhaust port. Since the catalytic converter element is arranged in the second aperture of the intermediate shell the entire exhaust gas has to pass the catalytic converter element to reach the exhaust port and thus the exhaust outlet aperture. In this way it can be ensured that complete catalytic treatment of the exhaust gas takes place.

With a further practical design of the exhaust system it can be provided that an insulating shell is provided between the intermediate shell and the rear shell, the contour of which more preferably is designed parallel to the inner side of the rear shell. This insulating shell serves as inner heat shield for the rear shell. Through this it can be achieved that the rear shell is not excessively heated either through the hot converted exhaust gases in the exhaust port. Consequently the exhaust port with this version is formed through the intermediate shell and the insulating shell. In addition it is practical that a gap more preferably an even one is present between the rear shell and the insulating shell. This gap for example can be filled out with glass fibre insulation in order to reduce the heat transfer from the insulating shell to the rear shell. Obviously other insulation materials can also be provided in the intermediate gap between rear shell and insulating shell. It is also mentioned at this point that the already mentioned shells: front shell, rear shell, intermediate shell and the insulating shell can consist of simple sheet metal, deep-drawn sheet metal, stainless steel sheet metal or similar. These shells can be additionally surface-treated in order to render them more resistant to aggressive exhaust gases.

In order to avoid that the insulating shell contacts the rear shell over a large area a spacer can be additionally provided as a result of which the previously mentioned gap between the rear shell and the insulating shell can be achieved. This spacer can more preferably be arranged in the region of the exhaust inlet aperture. Here the spacer can also have a perforation for the exhaust inlet aperture so that the exhaust gas originating from the internal combustion engine is directed through the spacer before it reaches the insulating shell and subsequently the intermediate shell or the prechamber.

With another version of the exhaust system according to the invention at least one perforated exhaust screen can be provided after the exhaust inlet aperture which more preferably can be arranged in the prechamber. This perforated exhaust screen serves to reduce sound. The perforated exhaust screen itself can be arranged in the prechamber on the intermediate plate. It is also conceivable to arrange the perforated exhaust screen on at least one spacer sleeve in a fixed location. This spacer sleeve itself can serve for leading a fastener through the exhaust system. To securely hold the exhaust system on the hand-held machine two fasteners can be provided which are attached in the region of the exhaust inlet aperture on the internal combustion engine. These fasteners can be guided into the engine through the spacer sleeves through which it is avoided that the fasteners deform the exhaust system upon tightening of the fasteners. These spacer sleeves can then also serve to fasten the perforated exhaust screen.

It is likewise conceivable that several perforations are also present in the intermediate shell all of which are provided with one or several catalytic converter elements through which the exhaust gas can reach the exhaust port from the prechamber.

With a particularly compact embodiment of the exhaust system the exhaust inlet aperture for the exhaust gas from the combustion chamber and an exhaust outlet aperture for the treated exhaust gas are provided in the rear shell. With this embodiment the exhaust gas initially flows from the internal combustion engine through the rear shell and, if applicable, insulation shell through the intermediate shell into the prechamber. From there the untreated exhaust gas reaches the storage chamber or directly the exhaust port through the additional aperture in the intermediate plate in which the catalytic converter element is also arranged. From the exhaust port the treated exhaust gas passes through the exhaust outlet aperture, which, if applicable, is provided in the insulating shell, if present, and in the rear shell, from the exhaust system into the environment.

Insofar as an insulating shell is used with the exhaust system according to the invention ventilation perforations can for example be provided in the rear shell through which fresh air reaches for cooling the exhaust system. This fresh air cools the insulating shell from its back which faces the rear shell. In this case, too, the engine cooling air can also be used for cooling the rear shell in that it is at least partly directed through the ventilation perforations. The exhaust outlet aperture can also be provided with a venturi nozzle through which the fresh ambient air is drawn into the exhaust system in order to bring about early mixing of the fresh air with the hot treated exhaust gases.

All parts of the exhaust system can be fastened through the two outer shells (front shell and rear shell) in that the outer housing is held together through folding over in the marginal region of the front shell and rear shell. Likewise it is conceivable to also rivet or screw together or join through other fastening methods such as welding, brazing or similar the front shell and the rear shell. Since the circumference of the intermediate plate in shape and size approximately corresponds to the marginal region of the front shell and the rear shell this is kept in a fixed location in the exhaust system upon joining the front shell and the rear shell. In addition, the present invention is also aimed at a hand-held implement, more preferably chainsaw, hedge trimmers, circular mower or such like with an internal combustion engine and an exhaust system according to any one of the claims 1 to 18.

BRIEF DESCRIPTION OF THE DRAWINGS

Additional measures and characteristics improving the invention are stated in the subclaims. Exemplary embodiments of the invention are presented in more detail in the following by means of the Figures. It shows in purely schematic representations:

BEST WAY TO CARRY OUT THE INVENTION

Figure 1A:
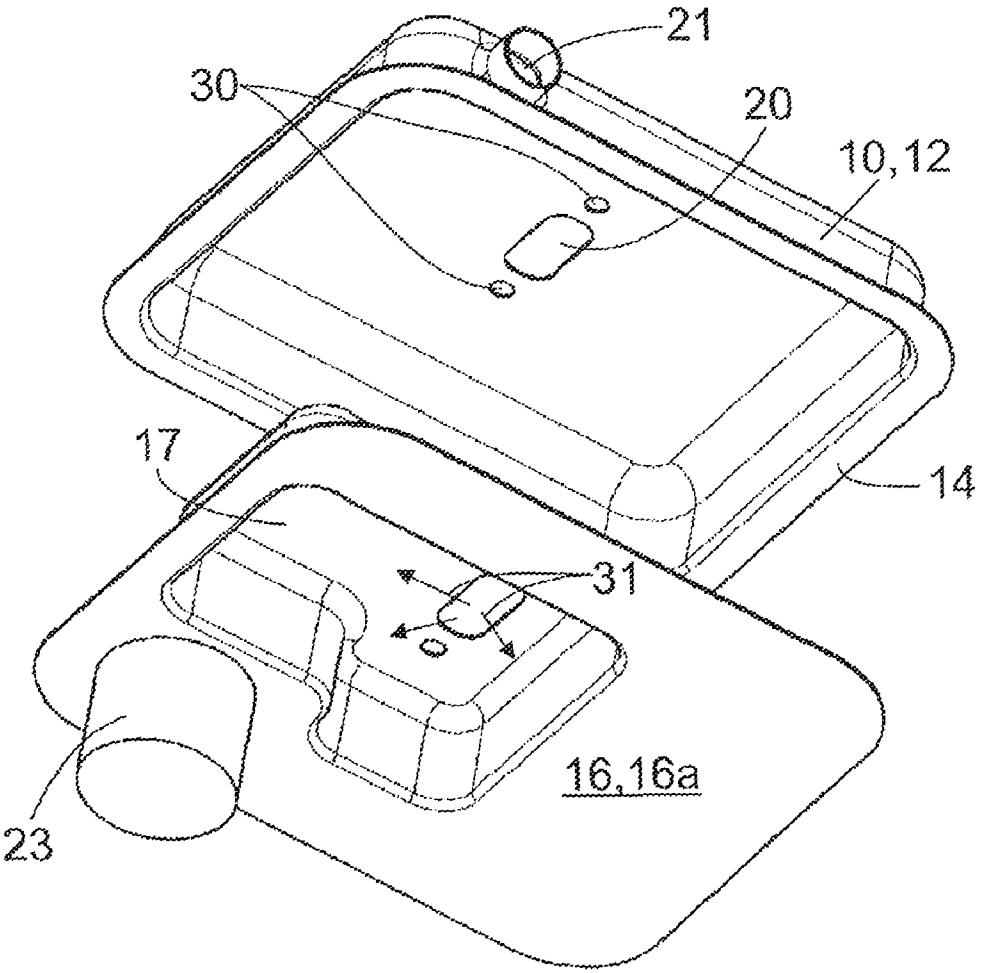
FIG. 1*a* a first perspective view of a rear shell and an intermediate shell of the exhaust system according to the invention, FIG. 1*b* a further perspective view of the back of the rear shell according to FIG. 1*a* where the intermediate shell inserted is represented in a translucent manner dash-dotted like, FIG. 1*c* a further perspective view of the front view of the combination of the rear shell with the inserted intermediate shell from FIG. 1*b*, FIG. 2*a* lateral view of a version of the exhaust system according to the invention in the installed state, FIG. 2*b* section IIb-IIb through the exhaust system from FIG. 2*a*, FIG. 2*c* top view of the exhaust system from FIG. 2*a*, more preferably of the front shell, FIG. 3 an exploded view of a further exhaust system according to the invention with an additional insulating shell, and FIG. 4 an exploded view of the exhaust system according to the invention from the FIG. 2*a* to *c*.

In FIG. 1*a* the rear shell 12 of the outer housing 10 of the exhaust system 100 according to the invention is shown with the intermediate shell 16 in perspective representation. In this view the complete front side 16*a* of the intermediate shell 16 is visible. Here, the moulded prechamber 17 protrudes from the back 16*b* of the intermediate shell 16. Through this protruding prechamber 17 the exhaust port 19 is formed between the intermediate shell 16 and the rear shell 12. The exhaust gas originating from the combustion chamber (see Arrow 31) enters the exhaust system through an exhaust inlet aperture 20 that is designed oval or rectangular. This exhaust inlet aperture 20 is arranged in the rear shell 12. To the left and right of the inlet aperture 20 apertures 30 for one or several fasteners can be provided which serve for the fastening of the exhaust system 100 to the internal combustion engine. The fasteners not shown protrude through the interior space of the exhaust system 100 so that comparable apertures 30 also need to be provided in the intermediate shell 16 on the left and right next to the exhaust inlet aperture 20 of the intermediate shell 16. The prechamber 17 formed in the intermediate shell 16 can be equipped with a perforated exhaust screen or a damping material. The exhaust gas 31 that flowed into the exhaust chamber 17 has to flow through the cylinder-shaped catalytic converter element 23 in order to reach through the corresponding aperture in the intermediate shell 16 which is covered by the catalytic converter element 23.

Figure 1C:
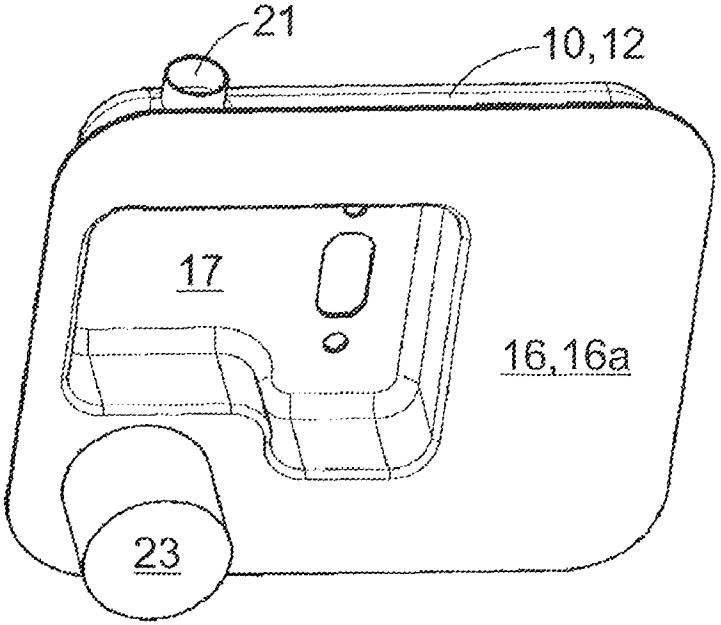
Figure 1B:
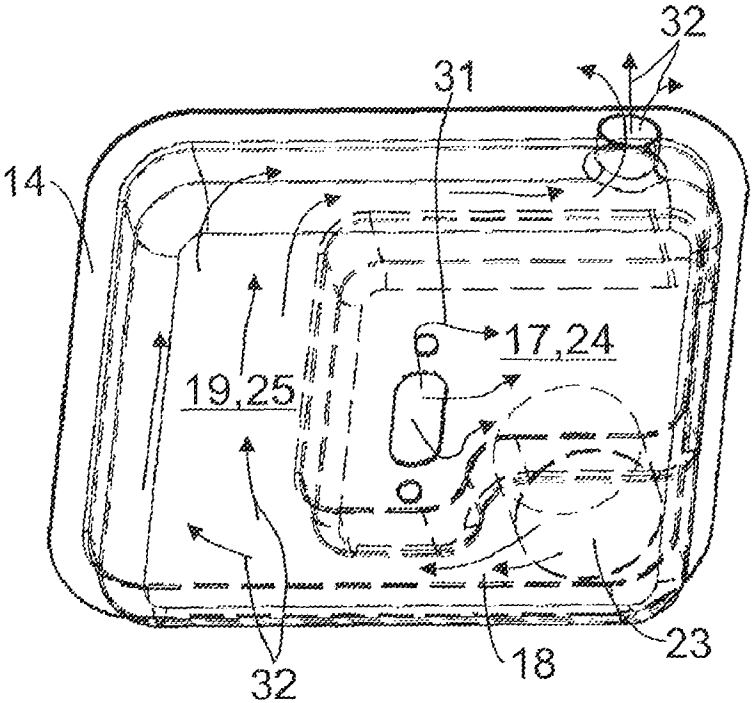

FIG. 1*b* shows a top view of the back of the rear shell 12 of the outer housing 10. Here, the inserted intermediate shell 16 is drawn in with the catalytic converter element 23 in a translucent and dashed manner. This FIG. 1 provides a good overview of the flow of the exhaust gas 31, 32. The designed exhaust port 19, which in the present case is designed U-shaped, is clearly visible in this Figure. As already described the untreated exhaust gas 31 enters the exhaust port 19 from the prechamber 17 through the catalytic converter element 23. Here, the storage chamber 18 formed upstream of the exhaust port 19 can be present as a result of which possible flames in the converted exhaust gas (see Arrow 32) can be extinguished. After the storage chamber 18 the exhaust gas 32 flows through the exhaust port 19 before it reaches the environment from an exhaust outlet aperture 21 in the rear shell 12. As is clearly visible in FIG. 1*b* the exhaust port 19 is passed about the cooler prechamber 17. As a result, cooling of the hot exhaust gas 32 in the exhaust port 19 is brought about. Here, the prechamber 17 can also have additional bulges or cooling surfaces 28 which protrude into the exhaust port 19.

FIG. 1*c* shows a top view of the preassembled intermediate shell 16, more preferably the front side 16*a*, of the intermediate shell 16 in the rear shell 12. This representation thus corresponds to the front view of the preassembled intermediate shell 16 in the rear shell 12 from FIG. 1*b*. Here it is evident that the existing cylinder-shaped catalytic converter element 23 is held against the intermediate shell 16. The catalytic converter element 23 can be a lattice-shaped or fabric-type structure which, rolled up, is held in a through aperture in the intermediate shell 16. Thus, this through aperture simultaneously serves as catalytic converter holder 22. A protruding margin in the intermediate shell 16 can also serve as catalytic converter holder 22. A honeycomb-like catalytic converter element 23 can likewise cover the through aperture in the intermediate shell 16. It is also conceivable that several catalytic converter elements 23 are provided which cover several through apertures in the intermediate shell 16. One or several bypass apertures are likewise conceivable to be able to adjust the desired conversion rate.

Figure 2C:
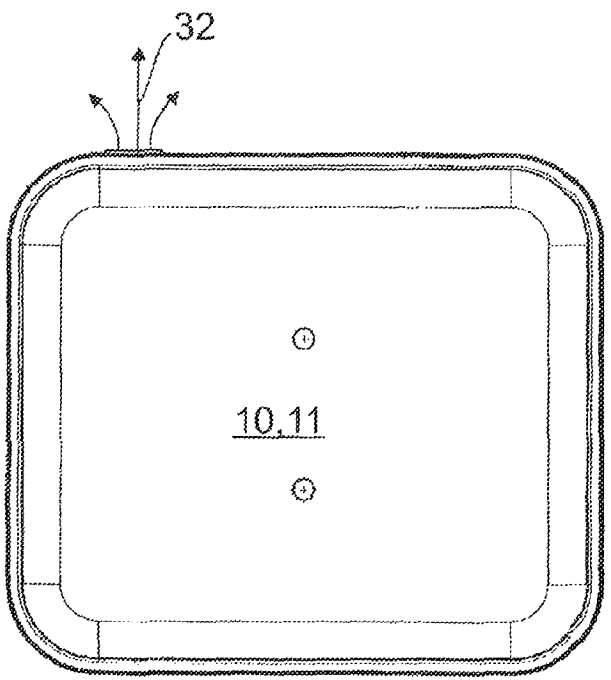
Figure 2B:
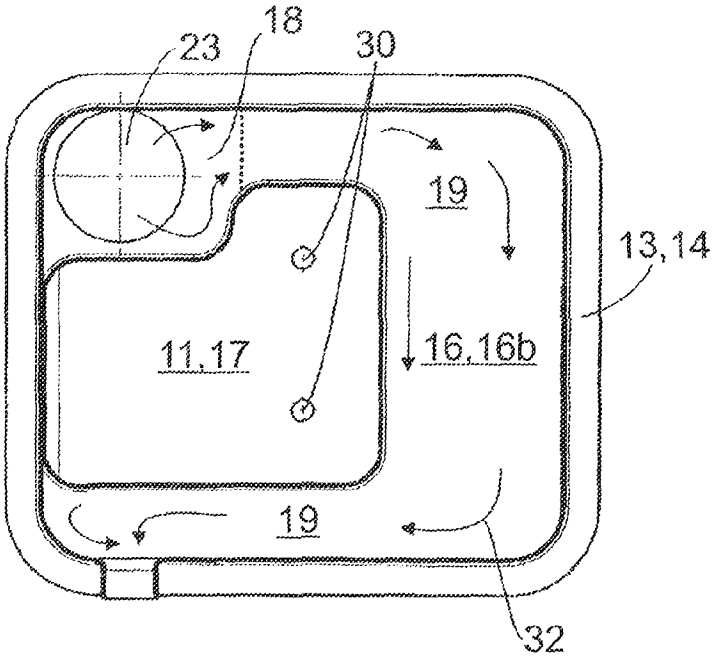
Figure 2A:
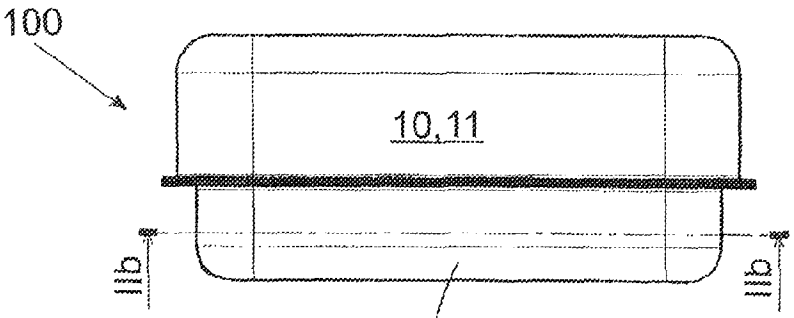

In FIG. 2*a* is shown a lateral view of the outer housing 10 of an exhaust system 100 according to the invention. Here it is clearly visible that the front shell 11 and the rear shell 12 form the outer housing 10. The two shell 11, 12 in their marginal regional 13 and 14 are folded over in this case. In addition, the compact design of the exhaust system 100 is also visible. FIG. 2*b* shows a cross section IIb-IIb through the exhaust system 100 from FIG. 2*a*. In this figure an exhaust gas flow of the exhaust gas 31, 32 is shown for clarification. Since with the shown cross section the exhaust port 19 has been cut as well the back 16*b* of the intermediate shell 16 is visible. In addition, the P-shaped contour of the prechamber 17 is clearly shown in the intermediate shell 16 about which the U-shaped exhaust port 19 is passed. This "U" is turned 90° anti-clockwise while on the upper leg start of the "U" the catalytic converter element 23 or the through aperture in the intermediate shell 16 is arranged. This is arranged in the provided storage chamber 18. From there the exhaust port 19 runs U-shaped about the prechamber 17. At the lower leg end of the "U" the outlet aperture 21 in the rear shell 12 is arranged through which the exhaust gas 32 reaches the environment. Upstream of the exhaust outlet aperture 21 a flame protection lattice can be additionally arranged. Likewise it is conceivable to design the exhaust outlet aperture 21 as venturi nozzle, through which the ambient air is to enter the exhaust port 19 in order to mix with the hot exhaust gas 32 even there.

FIG. 2*c* shows a top view of the exhaust system 100 from FIGS. 2*a* and 2*b*. In FIG. 2*c* is substantially shown the front or outside of the front shell 11. This has two apertures for two fasteners which are passed through the exhaust system 100 on the left and right next to the exhaust inlet aperture 20.

Figure 3:
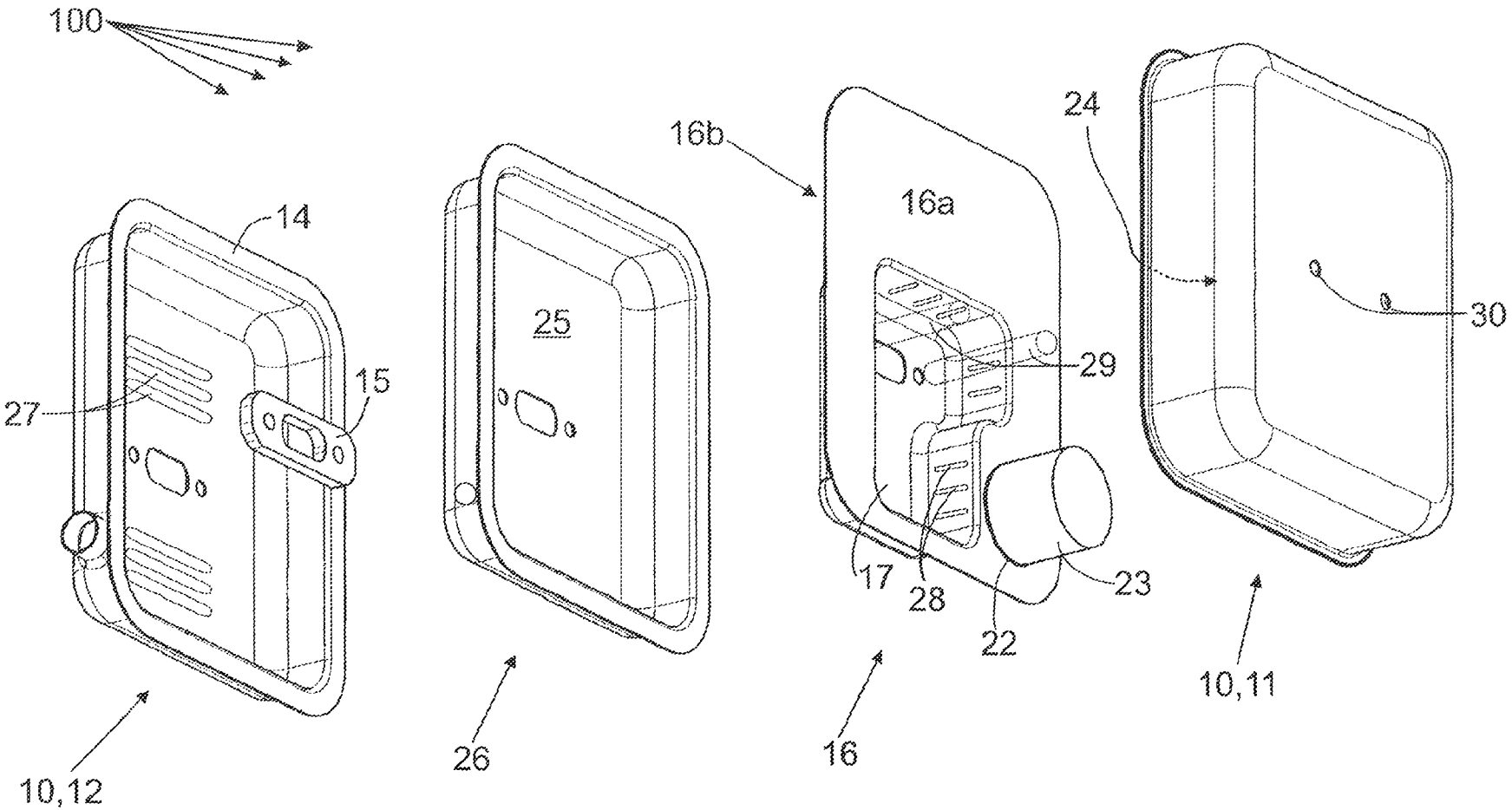

Another version of the exhaust system according to the invention 100 is shown in FIG. 3. In addition to the rear shell 12, the intermediate shell 16 and the front shell 10 it contains an insulating shell 26. This insulating shell 26 is arranged between the rear shell 12 and the intermediate shell 16. In order to arrange the insulating shell 26 at a predefined distance parallel to the contour of the rear shell 12 a spacer 15 is provided which is arranged in the region of the exhaust inlet aperture 20. For this reason the spacer 15 also has a comparable exhaust inlet aperture in the direction of the inlet aperture 20 in the rear shell 12. In addition, comparable apertures (see reference number 30) for fasteners in the spacer 15 are provided on the left and right next to this exhaust inlet aperture 20. Through the spacer 15 the insulating shell 26 is arranged at a predetermined distance parallel to the rear shell 12. Here, the thickness of the spacer 15 determines the depth of the intermediate gap. With the shown version of the exhaust system 100 from FIG. 3 the rear shell 12 quasi serves as heat shield for the insulating shell 26, which in the present case forms the exhaust port 19 with the intermediate shell 16. The intermediate plate 16 can also be arranged on the insulating shell 26 by means of a further spacer 15 which is not shown. To facilitate assembly of the exhaust system 100 the insulating shell 26 and the intermediate shell 16 can be riveted to the rear shell 12 by means of riveting nuts. Thus, easy preassembly of these three shell 12, 26 and 16 is possible.

The prechamber 17 can be moulded in the intermediate shell 16 which can be formed as a deep-drawn sheet. In addition, the intermediate shell 16 has a catalytic converter holder 22 in form of a folded-over margin or a bead in order to hold the cylinder-shaped catalytic converter element 23. In the prechamber 17 two spacer sleeves 29 can be provided (indicated dash-dotted in FIG. 3), through which the fasteners for fastening the exhaust system 100 can protrude. These two spacer sleeves 29 can simultaneously be used for holding a perforated exhaust screen which is not shown. The front 16*a* of the intermediate shell 16 is closed with the front shell 11 while the entire outer housing 10 can be brought about through folding-over of the marginal areas 13, 14 of the front shell 11 and 12. In addition, the two provided fasteners for fastening the exhaust system 100 to the cylinder can serve for holding the outer housing 10 together. As becomes clear from FIG. 3 the centre of gravity of the exhaust system 100 shown is not in the front region, i.e. in the region of the front shell 11, but rather in the rear region of the rear shell 12 and thus near the internal combustion engine of the hand-held implement. Thus, with the construction of the exhaust system 100 according to the invention an additional fastening or mounting of the exhaust system 100 on the implement can be omitted.

Figure 4:
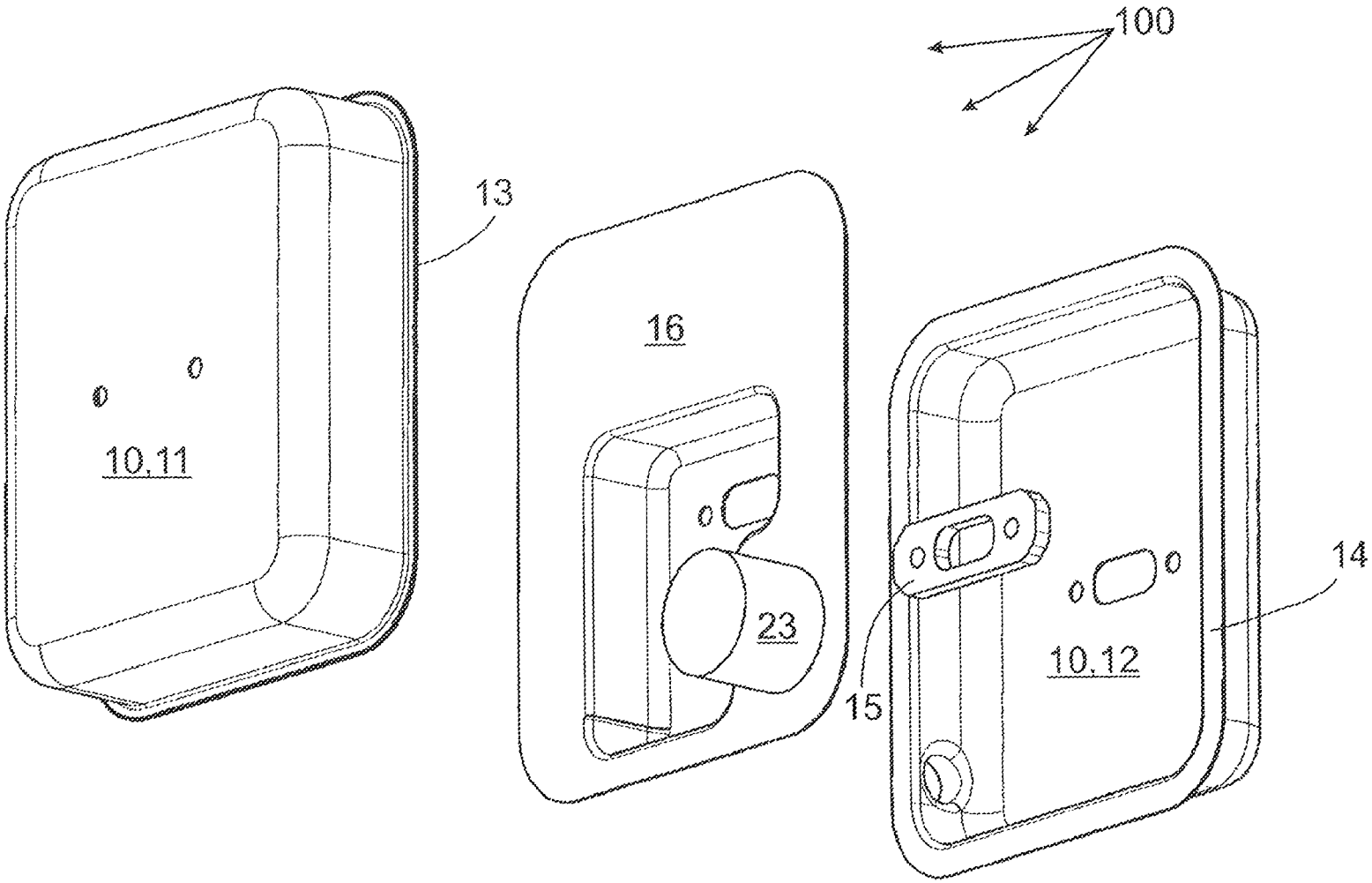

FIG. 4 shows an exploded view of the exhaust system 100 having only one intermediate shell 16. This intermediate shell 16 is likewise arranged spaced via a spacer 15 in the rear shell 12. From the front 16*a* the catalytic converter element 23 protrudes into a first region 24 which is formed through the front shell 11 and the intermediate shell 16. The prechamber 17 is also present in this first region 24. The second region 25 is separated from the first region 24 by the intermediate shell 16. Here, the second region 25 is formed by the intermediate shell 16 and the rear shell 12. The exhaust port 19 is provided in this region 25.

LIST OF REFERENCE NUMBERS

100 Exhaust system
10 Outer housing
11 Front shell
12 Rear shell
13 Marginal region of 11
14 Marginal region of 12
15 Spacer
16 Intermediate shell
16*a* Front of 16
16*b* Back of 16
17 Prechamber
18 Storage chamber
19 Exhaust port
20 Exhaust inlet aperture
21 Exhaust outlet aperture
22 Catalytic converter holder
23 Catalytic converter element (cylinder-shaped)
24 First region
25 Second region
26 Insulating shell
27 Ventilation perforations in 12
29 Spacer sleeve
30 Aperture for fastener
31 Arrow for exhaust gas from the combustion chamber
32 Arrow for treated exhaust gas

The invention claimed is:

1. An exhaust system for an internal combustion engine, comprising:

an outer housing including a front shell, a rear shell, a prechamber through which exhaust gas from a combustion chamber enters, and at least one intermediate shell having a front and back;

at least one catalytic converter holder disposed within the intermediate shell;

a catalytic converter element arranged on the catalytic converter holder; and an exhaust port from which exhaust gas from the catalytic converter element is directed;

characterized in that the intermediate shell forms the prechamber and the exhaust port;

characterized in that the exhaust gas from the catalytic converter element in the exhaust port is cooled by the prechamber; and characterized in that the prechamber has additional cooling surfaces which protrude into the exhaust port.

2. The exhaust system according to claim 1, characterized in that the catalytic converter holder is moulded in the intermediate shell of uniform material and in one piece.

3. The exhaust system according to claim 1, characterized in that the exhaust port is has a curvedor meander-shape.

4. The exhaust system according to claim 1, including a storage chamber formed by the intermediate shell upstream of the exhaust port.

5. The exhaust system according to claim 1, characterized in that the exhaust system is separated in two gas-tight regions by the intermediate shell.

6. The exhaust system according to claim 1, characterized in that in the rear shell an exhaust inlet aperture for the exhaust gas from the combustion chamber and an exhaust outlet aperture for the treated exhaust gas are provided.

7. The exhaust system according to claim 1, characterized in that in the rear shell, ventilation perforations are provided through which fresh air enters the exhaust system.

8. The exhaust system according to claim 1, characterized in that the outer housing is held together through folding over in a marginal region of the front shell and the rear shell.

9. The exhaust system according to claim 1, characterized in that several catalytic converter holders with corresponding catalytic elements are moulded into the intermediate shell.

10. The exhaust system according to claim 1, characterized in that at least one bypass aperture is moulded into the intermediate shell.

11. A hand-held implement, comprising a chainsaw, hedge trimmer, circular mower or such like with an internal combustion engine and an exhaust system according to claim 1.

12. The exhaust system according to claim 1, characterized in that the intermediate shell with the front shell forms the prechamber and with the rear shell forms the exhaust port.

13. The exhaust system according to claim 12, characterized in that in the front of the intermediate shell the prechamber, and in the back of the intermediate shell the exhaust port, are moulded of uniform material and in one piece.

14. An exhaust system for an internal combustion engine, comprising:

an outer housing including a front shell, a rear shell, a prechamber through which exhaust gas from a combustion chamber enters, and at least one intermediate shell having a front and back;

at least one catalytic converter holder disposed within the intermediate shell;

a catalytic converter element arranged on the catalytic converter holder; and an exhaust port from which exhaust gas from the catalytic converter element is directed;

characterized in that the intermediate shell forms the prechamber and the exhaust port; and characterized in that between the intermediate shell and the rear shell, an insulating shell is provided the contour of which is designed parallel to the inside of the rear shell.

15. The exhaust system according to claim 14, characterized in that between the rear shell and the insulating shell, a gap is present which can be filled out with glass fibre insulation.

16. An exhaust system for an internal combustion engine, comprising:

an outer housing including a front shell, a rear shell, a prechamber through which exhaust gas from a combustion chamber enters, and at least one intermediate shell having a front and back;

at least one catalytic converter holder disposed within the intermediate shell;

a catalytic converter element arranged on the catalytic converter holder; and an exhaust port from which exhaust gas from the catalytic converter element is directed;

characterized in that the intermediate shell forms the prechamber and the exhaust port; and characterized in that a spacer in the region of an exhaust inlet aperture, is arranged between the rear shell and the intermediate shell.

17. The exhaust system according to claim 16, characterized in that a perforated exhaust screen is provided downstream of the exhaust inlet aperture.

18. The exhaust system according to claim 17, characterized in that the exhaust system, through a fastener in the region of the exhaust inlet aperture, is held on the internal combustion engine, wherein the fastener can be guided through spacer sleeves.

19. The exhaust system according to claim 18, characterized in that the perforated exhaust screen is arranged on at least one spacer sleeve in a fixed location.

* * * * *